US008155569B2

(12) United States Patent
Yoshikawa et al.

(10) Patent No.: US 8,155,569 B2
(45) Date of Patent: Apr. 10, 2012

(54) TONER CARTRIDGE AND IMAGE FORMING APPARATUS

(75) Inventors: Yoshihiro Yoshikawa, Yamatokoriyama (JP); Kazuya Koyama, Ikoma (JP); Masanobu Deguchi, Kashiba (JP); Takeshi Wakabayashi, Kizugawa (JP); Yuhsuke Yoshimoto, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 702 days.

(21) Appl. No.: 12/337,782

(22) Filed: Dec. 18, 2008

(65) Prior Publication Data

US 2009/0162107 A1 Jun. 25, 2009

(30) Foreign Application Priority Data

Dec. 21, 2007 (JP) ..... 2007-330925

(51) Int. Cl.
*G03G 15/08* (2006.01)

(52) U.S. Cl. ..... 399/263; 399/103; 399/258

(58) Field of Classification Search ..... 399/258, 399/260, 262, 263, 102, 103
See application file for complete search history.

(56) References Cited

U.S. PATENT DOCUMENTS

| | | | | |
|---|---|---|---|---|
| 5,629,758 | A * | 5/1997 | Kageyama et al. | 399/263 |
| 7,167,668 | B2 * | 1/2007 | Sekiguchi | 399/258 |
| 7,386,250 | B2 * | 6/2008 | Ban et al. | 399/258 |
| 7,391,999 | B2 * | 6/2008 | Yamada | 399/262 |
| 7,409,180 | B2 * | 8/2008 | Seo | 399/258 |
| 2005/0175376 | A1 | 8/2005 | Sekiguchi | |

FOREIGN PATENT DOCUMENTS

| | | |
|---|---|---|
| JP | 63-004238 | 1/1998 |
| JP | 2003-057936 | 2/2003 |
| JP | 2005-338583 | 12/2005 |
| JP | 2006-003807 A | 1/2006 |

* cited by examiner

*Primary Examiner* — Susan Lee
(74) *Attorney, Agent, or Firm* — Nixon & Vanderhye, P.C.

(57) ABSTRACT

A toner cartridge has a toner storage chamber, a discharge outlet, a conveying screw, and a blocking wall. The discharge outlet serves to send out toner stored in the toner storage chamber, and the conveying screw serves to convey the toner stored in the toner storage chamber. Further, before the toner cartridge mounted into an image forming apparatus, the blocking wall is located in a space between a toner area, which is an area in the toner storage chamber where the toner exists, and the discharge outlet, thereby putting the space in a blocked state. The toner cartridge further includes a driving mechanism for, when the toner cartridge has been mounted into the image forming apparatus, driving the conveying screw by power transmitted from the image forming apparatus, so as to cancel the blocked state.

9 Claims, 12 Drawing Sheets

TONER CARTRIDGE AND IMAGE FORMING APPARATUS

This Nonprovisional application claims priority under 35 U.S.C. §119(a) on Patent Application No. 330925/2007 filed in Japan on Dec. 21, 2007, the entire contents of which are hereby incorporated by reference.

FIELD OF THE TECHNOLOGY

The present technology relates to a toner cartridge to be detachably mounted into an electrophotographic image forming apparatus.

BACKGROUND OF THE TECHNOLOGY

An electrophotographic image forming apparatus such as a printer, a copier, or a multifunction printer has a toner cartridge, detachably mounted therein, which contains toner for use in a printing process, and the toner contained in the toner cartridge is gradually consumed every time a printing process is performed. When the toner cartridge is emptied, the image forming apparatus have the empty toner cartridge replaced by a toner cartridge full of toner.

FIG. 1 shows an internal structure of a conventional toner cartridge yet to be mounted into an image forming apparatus. As shown in FIG. 1, the toner cartridge 100 includes: a housing 101 for containing toner, a dropping outlet 102, provided on a bottom surface of the housing 101, via which the toner contained in the housing 101 is dropped out of the housing 101; a toner conveying screw 103, provided in the housing 101, which conveys the toner close to the dropping outlet 102; and a drive gear 104 linked to the toner conveying screw 103. The toner cartridge 100 further includes: a shutter 105 placed on an outside wall of the housing 101 so as to cover the dropping outlet 102 externally; and a heat seal 106 sandwiched between the dropping outlet 102 and the shutter 105.

According to the foregoing arrangement, before the toner cartridge 100 is mounted into the image forming apparatus, the heat seal 106 and the shutter 105 seal the dropping outlet 102 externally so as to prevent the toner from leaking through the dropping outlet 102. When a user pulls out the heat seal 106 from the toner cartridge 100 and places the toner cartridge 100, from which the heat seal 106 has been pulled out, into the image forming apparatus, the shutter 105 slides automatically so that the dropping outlet 102 is exposed and the toner contained in the housing 101 flows into a developing device (not shown) of the image forming apparatus via the dropping outlet 102.

(Patent Document 1)

Japanese Unexamined Patent Application Publication No. 57936/2003 (Tokukai 2003-57936; published on Feb. 28, 2003)

Immediately before the user places the above-mentioned toner cartridge 100 into the image forming apparatus, the user shakes the toner cartridge 100 by hand in order to cause the toner to be uniformly dispersed in the housing 101, and then pulls out the heat seal 106.

Unfortunately, the shaking of the toner cartridge 100 by the user causes the toner to adhere to the heat seal 106, and the subsequent pulling out of the heat seal 106 by the user causes the toner adhering to the heat seal 106 to be scattered around to dirty the user's hands and surroundings.

SUMMARY OF THE TECHNOLOGY

The present technology has been made in order to solve the foregoing problems, and it is an object to inhibit dirt from occurring when a toner cartridge is mounted into an image forming apparatus.

A toner cartridge according to the present technology is a toner cartridge to be mounted into an electrophotographic image forming apparatus, the toner cartridge including: a toner storage chamber having toner stored therein and provided with a discharge outlet via which the toner is discharged out of the toner cartridge; a conveying screw, provided in the toner storage chamber, which conveys the toner stored in the toner storage chamber; a blocking wall, formed as a part of the conveying screw, which is located in a space between a toner area and the discharge outlet, thereby putting the space in a blocked state, the toner area being an area in the toner storage chamber where the toner exists; and a driving mechanism for, when the toner cartridge has been mounted into the image forming apparatus, driving the conveying screw by power transmitted from the image forming apparatus, so as to cancel the blocked state.

According to the foregoing arrangement, before such a toner cartridge is mounted into the image forming apparatus, the blocking wall blocks the space between the toner area, which is an area in the toner storage chamber where the toner exists, and the discharge outlet, so that the toner stored in the toner storage chamber will not reach the discharge outlet and therefore will not leak through the discharge outlet. Moreover, when the toner cartridge has been mounted into the image forming apparatus, the driving mechanism moves the conveying screw with use of power transmitted from the image forming apparatus, so as to cancel the blocked state. Therefore, after the toner cartridge has been mounted into the image forming apparatus, the toner stored in the toner storage chamber can reach the discharge outlet, so that the toner can be discharged out of the toner cartridge via the discharge outlet.

That is, the arrangement of the present technology does not require a heat seal required for a conventional toner cartridge, can prevent leakage of the toner through the discharge outlet before the mounting, and can also discharge the toner via the discharge outlet 64 after the mounting. This makes it possible to inhibit dirt from occurring due to use of the heat seal (to inhibit dirt from occurring in the user's hands and surroundings due to the toner scattered around when the heat seal was pulled out).

Additional objects, features, and strengths of the present technology will be made clear by the description below. Further, the advantages of the present technology will be evident from the following explanation in reference to the drawings.

BRIEF DESCRIPTION OF THE DRAWINGS

FIG. 8(*b*) shows the internal structure of the toner cartridge, shown in FIG. 8(*a*), which has been mounted into the image forming apparatus and whose conveying screw is moving. FIG. 8(*c*) shows the internal structure of the toner cartridge, shown in FIG. 8(*a*), which has been mounted into the image forming apparatus and whose conveying screw has finished moving.

FIG. 10(*b*) shows the internal structure of the toner cartridge, shown in FIG. 10(*a*), which has been mounted into the image forming apparatus and whose conveying screw is moving. FIG. 10(*c*) shows the internal structure of the toner cartridge, shown in FIG. 10(*a*), which has been mounted into the image forming apparatus and whose conveying screw has finished moving.

FIG. 11(*b*) shows the internal structure of the toner cartridge, shown in FIG. 11(*a*), which has been mounted into the image forming apparatus and whose conveying screw is moving. FIG. 11(*c*) shows the internal structure of the toner cartridge, shown in FIG. 11(*a*), which has been mounted into the image forming apparatus and whose conveying screw has finished moving.

FIG. 12(*b*) shows a toner cartridge whose discharge outlet has been exposed.

DESCRIPTION OF THE EMBODIMENTS

The following first describes an image forming apparatus into which a toner cartridge according to an embodiment of the present technology is mounted.

[Arrangement of an Image Forming Apparatus]

Figure 2:
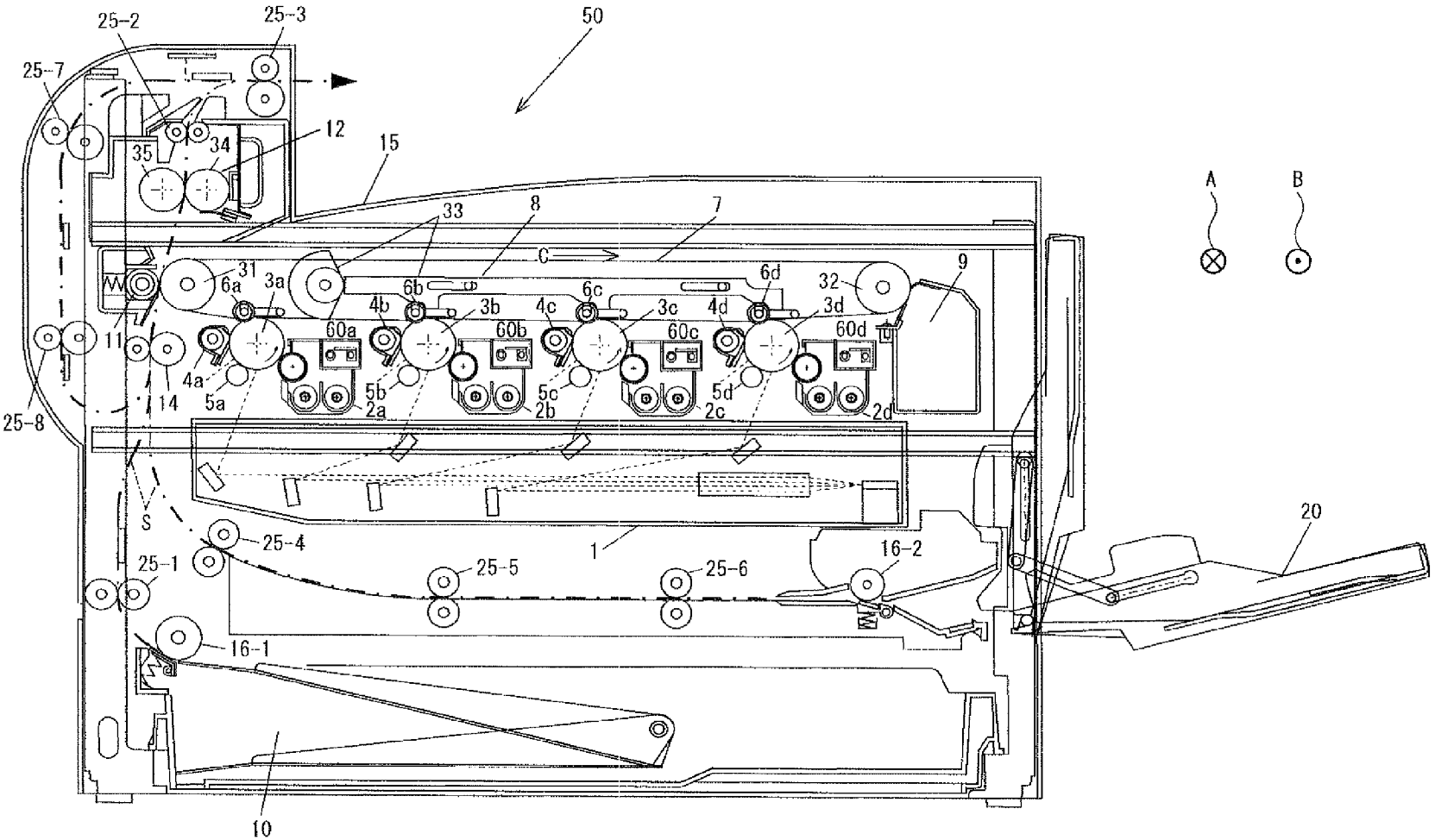
FIG. 2 schematically shows the interior of an image forming apparatus according to an embodiment of the present technology.

FIG. 2 shows an internal structure of an image forming apparatus 50 into which a toner cartridge according to the present embodiment is mounted. The image forming apparatus 50 is an electrophotographic printer that forms a multicolor or monochrome image on a sheet (recording paper sheet) in accordance with digital image data inputted from an outside source or obtained by scanning a document.

The image forming apparatus 50 processes image data for each color component, namely black (K), cyan (C), magenta (M), and yellow (Y), forms a black image, a cyan image, a magenta image, and a yellow image, and then forms a color image by superimposing the four images onto one another. Therefore, as shown in FIG. 2, the image forming apparatus 50 includes four developing devices 2 (2*a*, 2*b*, 2*c*, 2*d*), four photoreceptor drums 3 (3*a*, 3*b*, 3*c*, 3*d*), four chargers 5 (5*a*, 5*b*, 5*c*, 5*d*), four cleaner units 4 (4*a*, 4*b*, 4*c*, 4*d*) so as to form images respectively corresponding to the color components. The letters a, b, c, and d represent a member for use in formation of a black image, a member for use in formation of a cyan image, a member for use in formation of a magenta image, and a member for use in formation of a yellow image, respectively. The image forming apparatus 50 further includes an exposure unit 1, a fixing unit 12, a sheet conveying path S, a paper feeding cassette 10, and a paper output tray 15.

The photoreceptor drums 3 are placed high in the interior of the image forming apparatus 50. The chargers 5 causes surfaces of the photoreceptor drums 3 to be uniformly charged at predetermined potentials, respectively. The chargers 5 may be roller-type chargers as shown in FIG. 2, or may be brush-type chargers.

As shown in FIG. 2, the exposure unit 1 is a laser scanning unit (LSU) including a laser irradiation section and a reflection mirror. However, the exposure unit 1 is not limited to the LSU, and may be an EL or LED writing head including an array of light-emitting elements. The exposure unit 1 exposes the surfaces of the photosensitive drums 3 in accordance with digital image data inputted, thereby forming electrostatic latent images on the surfaces of the photosensitive drums 3 in accordance with the digital image data, respectively.

The developing devices 2 visualize, with four types of toner (black (K) toner, cyan (C) toner, magenta (M) toner, yellow (Y) toner), the electrostatic latent images formed on the photosensitive drums 3, respectively. The cleaner units 4 remove and collect toner remaining on the surfaces of the photosensitive drums 3 after the visualization (development) and image-transferring steps.

Placed above the photosensitive drums 3 is an intermediate transfer belt unit 8 including intermediate transfer rollers 6 (6*a*, 6*b*, 6*c*, 6*d*), an intermediate transfer belt 7, an intermediate transfer belt driving roller 31, an intermediate transfer belt driven roller 32, an intermediate transfer belt tension mechanism 33, and an intermediate transfer belt cleaning unit 9.

The intermediate transfer rollers 6, the intermediate transfer belt driving roller 31, the intermediate transfer belt driven roller 32, and the intermediate transfer belt tension mechanism 33 causes the intermediate transfer belt 7 to be provided in a tension state, and to be driven to rotate in Direction C (see FIG. 2).

The intermediate transfer rollers 6 are rotatably supported in intermediate transfer roller attaching portions of the intermediate transfer belt tension mechanism 33, respectively.

The intermediate transfer belt (intermediate transfer member) 7 is provided so as to make contact with each of the photosensitive drums 3. The toner images formed on the respective photosensitive drums 3 so as to correspond to the respective colors are transferred onto the intermediate transfer belt 7 so as to be sequentially superimposed onto one another, with the result that the color toner image (multicolor toner image) is formed on the intermediate transfer belt 7. The intermediate transfer belt 7 is made of a film approximately 100 μm to 150 μm thick so as to have no ends.

The transfer of the toner images from the photosensitive drums 3 onto the intermediate transfer belt 7 (such a transfer being hereinafter referred to sometimes as "first transfer") is performed by the intermediate transfer rollers 6 making contact with a back side of the intermediate transfer belt 7. To each of the intermediate transfer rollers 6, a high-voltage transfer bias (high voltage whose polarity (+) is reverse to the charging polarity (−) of the toner) is applied for the purpose of the first transfer of the toner images from the photosensitive drums onto the intermediate transfer belt 7.

The intermediate transfer roller 6 has, as its base, a metal (e.g., stainless-steel) shaft having a diameter of 8 mm to 10 mm. The intermediate transfer roller 6 has a surface covered with an electrically-conductive elastic material (e.g., EPDM and urethane foam). Such an electrically-conductive elastic material enables the intermediate transfer roller 6 to apply the high voltage uniformly to the intermediate transfer belt 7. The intermediate transfer roller 6 employs a roller-type transfer electrode in the present embodiment, but may employ a brush-type transfer electrode instead.

As mentioned above, the electrostatic latent images formed respectively on the respective photosensitive drums 3 are visualized in accordance with the respective hues to become toner images, and these toner images are superimposed onto the intermediate transfer belt 7. The toner images thus superimposed are sent, by the rotation of the intermediate transfer belt 7, to a position of contact between a paper sheet and a transfer roller 11 (such a position being hereinafter referred to sometimes as "transfer section"). In the position of contact, the toner images are transferred onto the paper sheet by the transfer roller 11. It should be noted here that the transfer of the toner from the intermediate transfer belt 7 onto the paper sheet (medium on which an image is formed) (such a transfer being hereinafter referred to sometimes as "second transfer") is realized when the intermediate transfer belt 7 and the transfer roller 11 are pressed against each other so that a predetermined nip is formed between the intermediate transfer belt 7 and the transfer roller 11, and a transfer bias (second transfer bias) for transferring the toner images onto the paper sheet is applied to the transfer roller 11. The second transfer bias is a high voltage whose polarity (+) is reverse to the charging polarity (−) of the toner.

Further, while one of the transfer roller 11 and the intermediate transfer belt driving roller 31 is made of a hard material (e.g., metal), the other is made of a soft material (e.g., elastic rubber or resin foam). With this, the nip can be constantly obtained.

Further, as described above, the toner adheres to the intermediate transfer belt 7 as the result of the contact of the intermediate transfer belt 7 with the photosensitive drums 3, or the toner is not transferred onto the paper sheet by the transfer roller 11 and accordingly remains on the intermediate transfer belt 7. Such toner causes a mixture of the colors of toner in the next step. Therefore, the toner is removed and collected by the intermediate transfer belt cleaning unit 9. The intermediate transfer belt cleaning unit 9 includes a cleaning blade that makes contact with the intermediate transfer belt 7. That portion of the intermediate transfer belt 7 which makes contact with the cleaning blade is supported by the intermediate transfer belt driven roller 32 so that the back side of the portion makes contact with the intermediate transfer belt driven roller 32

The paper feeding cassette 10 serves to have sheets (recording paper sheet) stored therein for use in image formation. The paper feeding cassette 10 is provided below the photosensitive drums 3 and the exposure unit 1. Meanwhile, the paper output tray 15, which is provided on top of the image forming apparatus 50, serves as a tray for loading a printed sheet in a face-down manner, i.e., in such a manner that a printed side of the sheet faces down.

Further, the image forming apparatus 50 is provided with the sheet conveying path S through which a sheet is sent from the paper feeding cassette 10 a manual paper feeding tray 20 to the paper output tray 15 via the transfer roller 11 and the fixing section 12. Disposed along the sheet conveying path S from the paper feeding section 10 to the paper output tray 15 are pickup rollers 16, a registration roller 14, the transfer section including the transfer roller 11, the fixing unit 12, and conveying rollers 25.

Each of the conveying rollers 25 is a small roller for facilitating/assisting the conveyance of a sheet. The conveying rollers 25 are provided along the sheet conveying path S. The pickup roller 16-1 is a feeding roller provided on one end of the paper feeding cassette 10 so as to feed one sheet at a time to the sheet conveying path S. The pickup roller 16-2 is a feeding roller provided near the manual paper feeding tray 20 so as to feed one sheet at a time to the sheet conveying path S. The registration roller 14 temporarily suspends the conveyance of a sheet via the sheet conveying path S. At such timing that the head of the sheet is aligned with the head of each of the toner images superimposed on the intermediate transfer belt 7, the registration roller 14 conveys the sheet to the transfer section.

The fixing unit 12 includes a heat roller 34 and a pressure roller 35. The heat roller 34 and the pressure roller 35 rotate with the sheet sandwiched therebetween. The heat roller 34 is controlled by a control section (not shown) so as to be at a predetermined fixing temperature. The control section controls the temperature of the heat roller 34 in accordance with a detection signal sent from a temperature detector (not shown). The sheet sandwiched between the heat roller 34 and the pressure roller 35 is subjected to heat and pressure. With this, the toner images, transferred onto the sheet, which correspond to the respective colors are melted, mixed with one another, pressed against one another, and then fixed onto the sheet by heat. The paper sheet having the multicolor toner image (images corresponding to the respective colors) fixed thereon is conveyed by the plurality of conveying rollers 25 to a reverse paper output path of the sheet conveying path S, and is then outputted onto the paper output tray 15 in a reversed manner (i.e., in such a manner that the multicolor toner image faces down).

The following describes an operation of conveying a sheet through the sheet conveying path S. As described above, the image forming apparatus 50 is provided with the paper feeding cassette 10 having sheets stored in advance therein and the manual paper feeding tray 20 for use in printing a small number of sheets. The paper feeding cassette 10 and the manual paper feeding tray 20 are provided with the pickup rollers 16 (16-1, 16-2), respectively. Each of these pickup rollers 16 feeds one sheet at a time to the sheet conveying path S.

(Case of Single-Side Printing)

A sheet conveyed from the paper feeding cassette 10 is conveyed to the registration roller 14 by a conveying roller 25-1 provided in the sheet conveying path S. At such timing that the head of the sheet is aligned with the head of each of the toner images superimposed on the intermediate transfer belt 7, the sheet is conveyed to the transfer section, where the toner images are transferred onto the sheet. The toner images are fixed onto the sheet by the fixing unit 12. Thereafter, the sheet is outputted from a conveying roller 25-3 onto the paper output tray 15 via a conveying roller 25-2.

A sheet conveyed from the manual paper sheet feeding tray 20 conveyed to the registration roller 14 by a plurality of conveying rollers (25-6, 25-5, 25-4). Thereafter, the sheet is outputted onto the paper output tray 15 after being subjected to the same process as the sheet fed from the paper feeding cassette 10.

(Case of Double-Side Printing)

After the sheet subjected to the single-side printing passes through the fixing section 12, the back end of the sheet is clamped by the conveying roller 25-3. The conveying roller 25-3 rotates in the reverse direction so as to guide the sheet to conveying rollers (25-7, 25-8). Thereafter, the sheet is subjected to back-side printing after passing through the registration roller 14, and is then outputted onto the paper output tray 15.

Further, the image forming apparatus 50 has toner cartridges 60*a*, 60*b*, 60*c*, and 60*d* detachably provided therein so as to supply toner to the developing devices 2*a*, 2*b*, 2*c*, and 2*d* in response to toner depletion, respectively.

The four toner cartridges 60*a*, 60*b*, 60*c*, and 60*d* of the image forming apparatus 50 are identical in structure to one another. Therefore, the content of a description given below simply with reference to "toner cartridge 60" applies to all of the toner cartridges 60*a*, 60*b*, 60*c*, and 60*d*.

Figure 3:
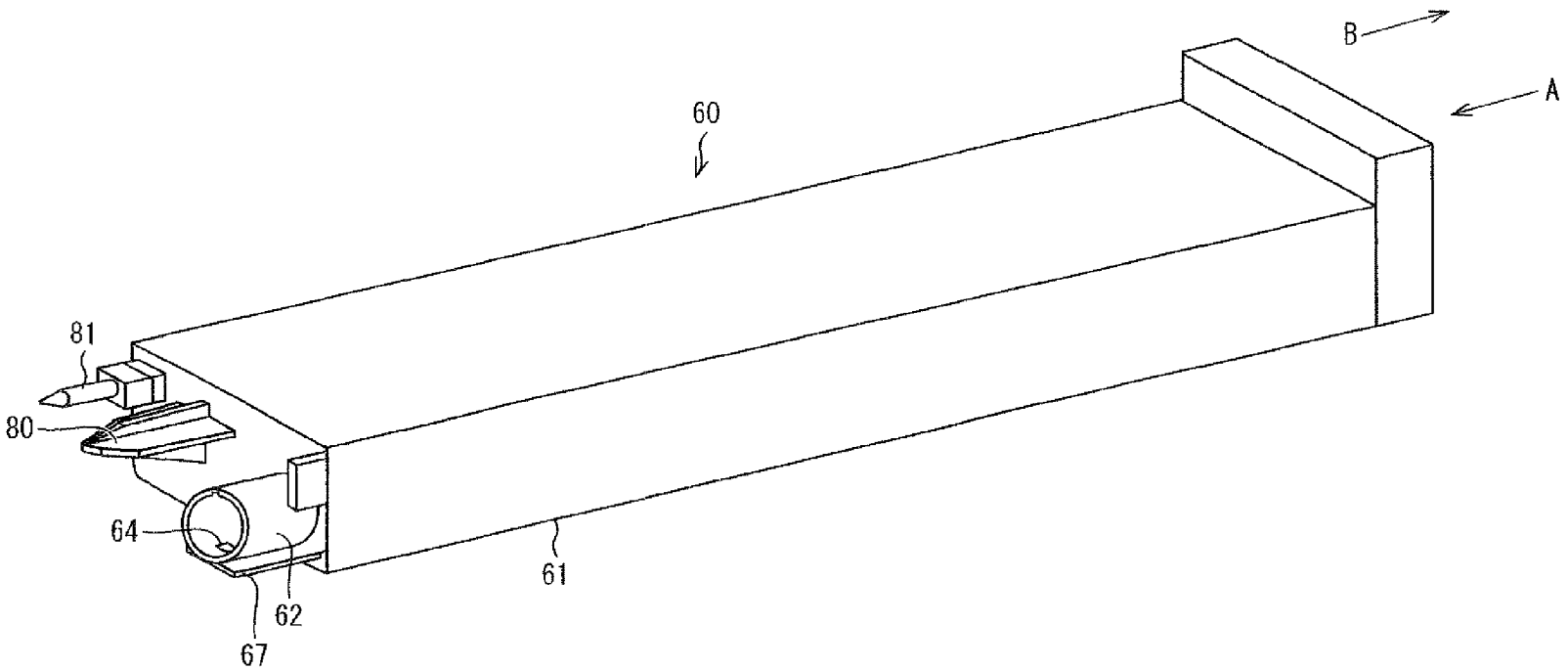
FIG. 3 is a perspective view of a toner cartridge according to an embodiment of the present technology.

As shown in FIG. 3, a toner cartridge 60 according to the present embodiment has a substantially rectangular shape. The toner cartridge 60 is mounted into the image forming apparatus 50 in Direction A, which extends from the front side of the image forming apparatus 50 to the rear side, so that the longer sides of the shape extend along Direction A. In the present specification and drawings, the direction extending from the front side of the image forming apparatus 50 to the rear side is referred to as "Direction A" as described above, and the direction extending from the rear side of the image forming apparatus 50 to the front side is referred to as "Direction B" (see FIG. 2). That is, Direction B is a direction opposite to Direction A.

Each of the toner cartridges 60*a*, 60*b*, 60*c*, and 60*d* is slid so as to be placed on a developing device 2 that develops with use of toner identical in color to toner contained in the toner cartridge. Moreover, each of the toner cartridges 60*a*, 60*b*, 60*c*, and 60*d* is structured to supply toner via a discharge outlet to a developing device 2 that develops with use of toner identical in color to toner contained in the toner cartridge. The following details the structure of a toner cartridge 60.

[Arrangement of a Toner Cartridge]

Figure 4:
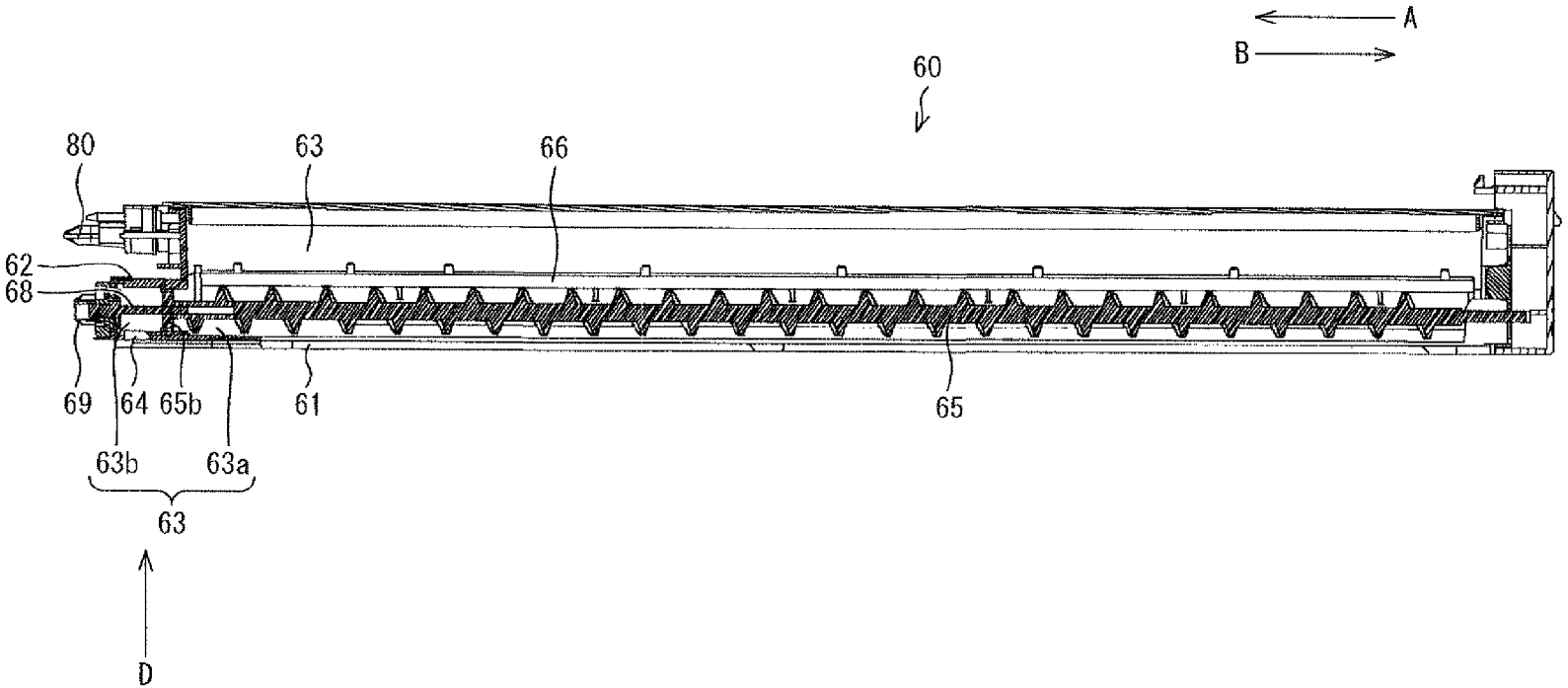
FIG. 4 schematically shows the interior of the toner cartridge shown in FIG. 3.
Figure 5:
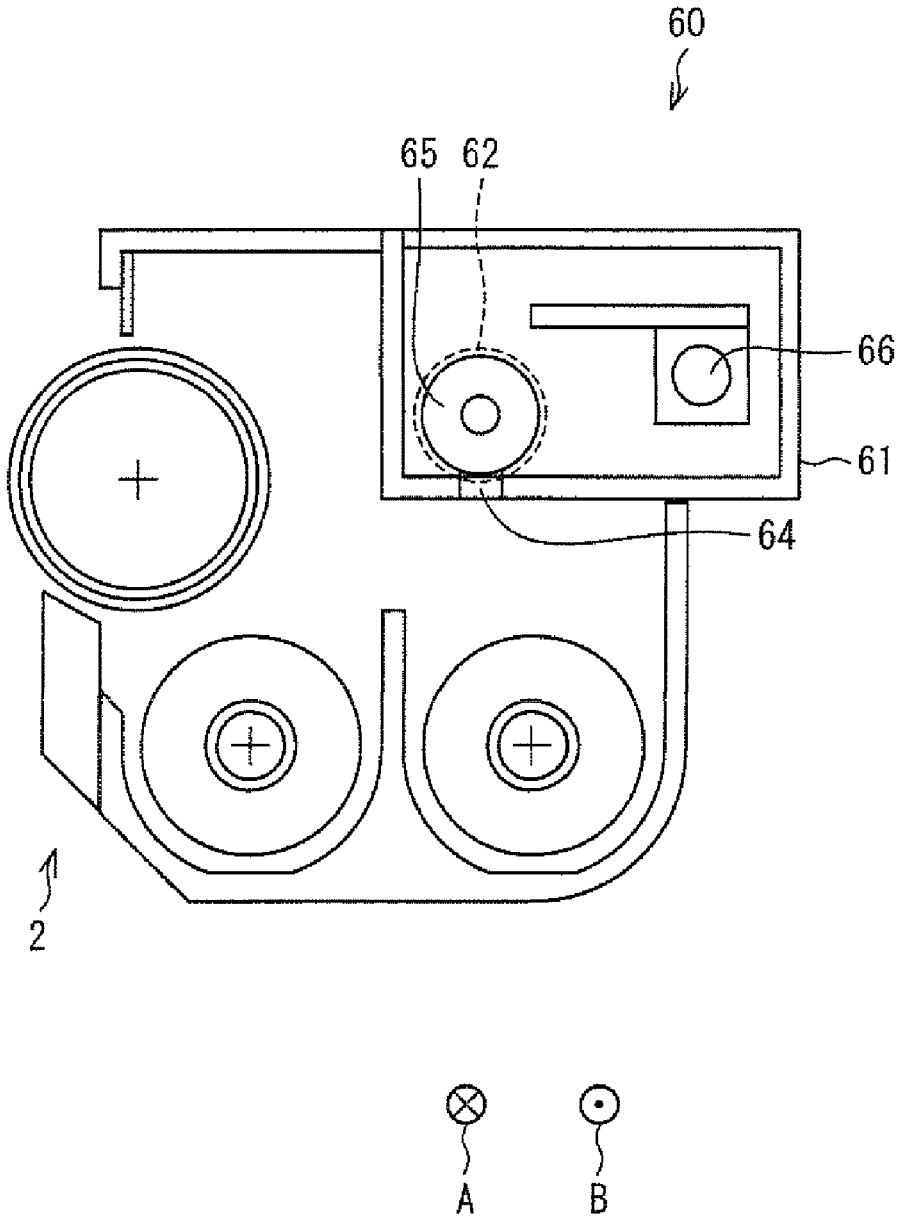
FIG. 5 schematically shows a developing device contained in the image forming apparatus of FIG. 2 and a toner cartridge placed on top of the developing device.

FIG. 3 is a perspective view of a toner cartridge 60 according to the present embodiment. FIG. 4 schematically shows the interior of the toner cartridge 60 according to the present embodiment. FIG. 5 schematically shows the toner cartridge 60, which has been mounted on top of a developing device 2. For convenience of explanation, FIG. 3 omits a drive gear 69 shown in FIG. 4.

As shown in FIG. 3, the toner cartridge 60 has a rectangular housing 61, a cylindrical tube 62 connected to the housing 61, and protruding members 80 and 81 formed on an outside wall of the housing 61 so as to protrude in Direction A. It should be noted that the interior of the housing 61 and the inside of the cylindrical tube 62 are in communication with each other.

The toner cartridge 60 is mounted into the image forming apparatus 50 by fitting the protruding members 80 and 81 into positioning holes (not shown) formed in the image forming apparatus 50.

Moreover, as shown in FIGS. 3 and 4, the toner cartridge 60 is arranged so as to have a toner storage chamber 63, a discharge outlet 64, a conveying screw 65, a stirring bar 66, and a shutter 67.

The toner storage chamber 63 is a space composed of a toner storage area 63*a* and a toner conveying area 63*b*. The toner storage area 63*a* is an internal space of the housing 61, and the toner conveying area 63*b* is an internal space of the cylindrical tube 62. It should be noted that the toner storage area 63*a* and the toner conveying area 63*b* are disposed so as to be arrayed along Direction A, and that the toner storage area 63*a* and the toner conveying area 63*b* are in communication with each other.

Figure 6:
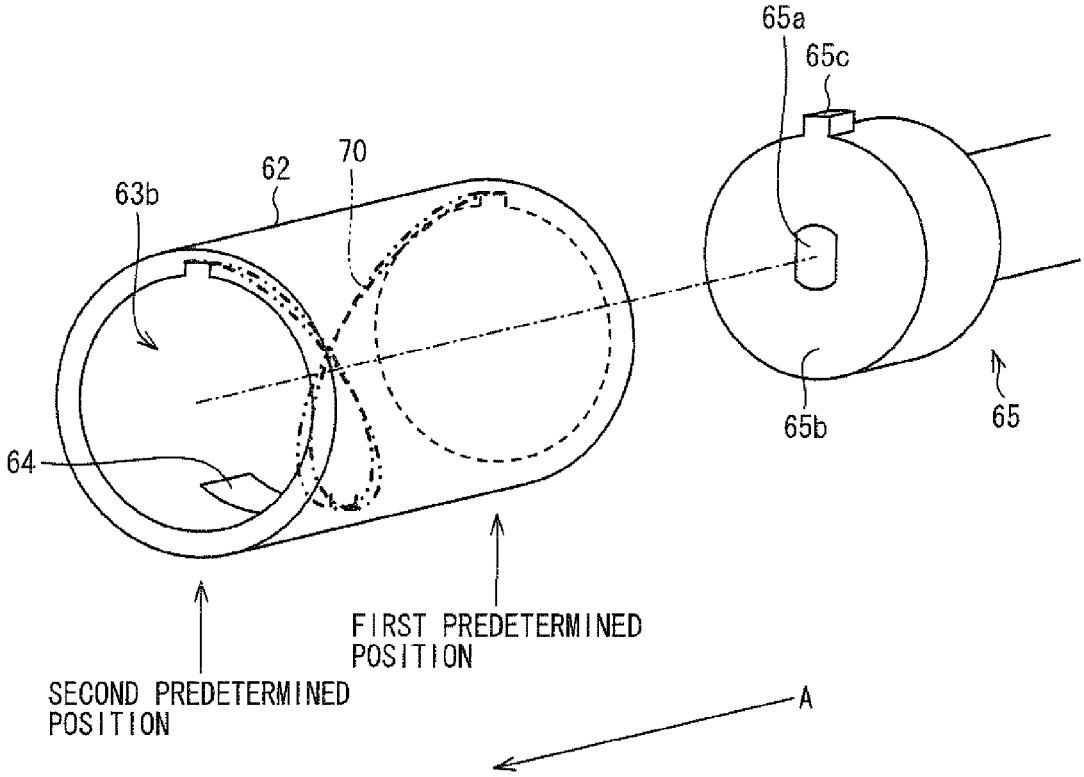
FIG. 6 is a perspective view of a cylindrical tube and a conveying screw each contained in the toner cartridge shown in FIG. 3.
Figure 7:
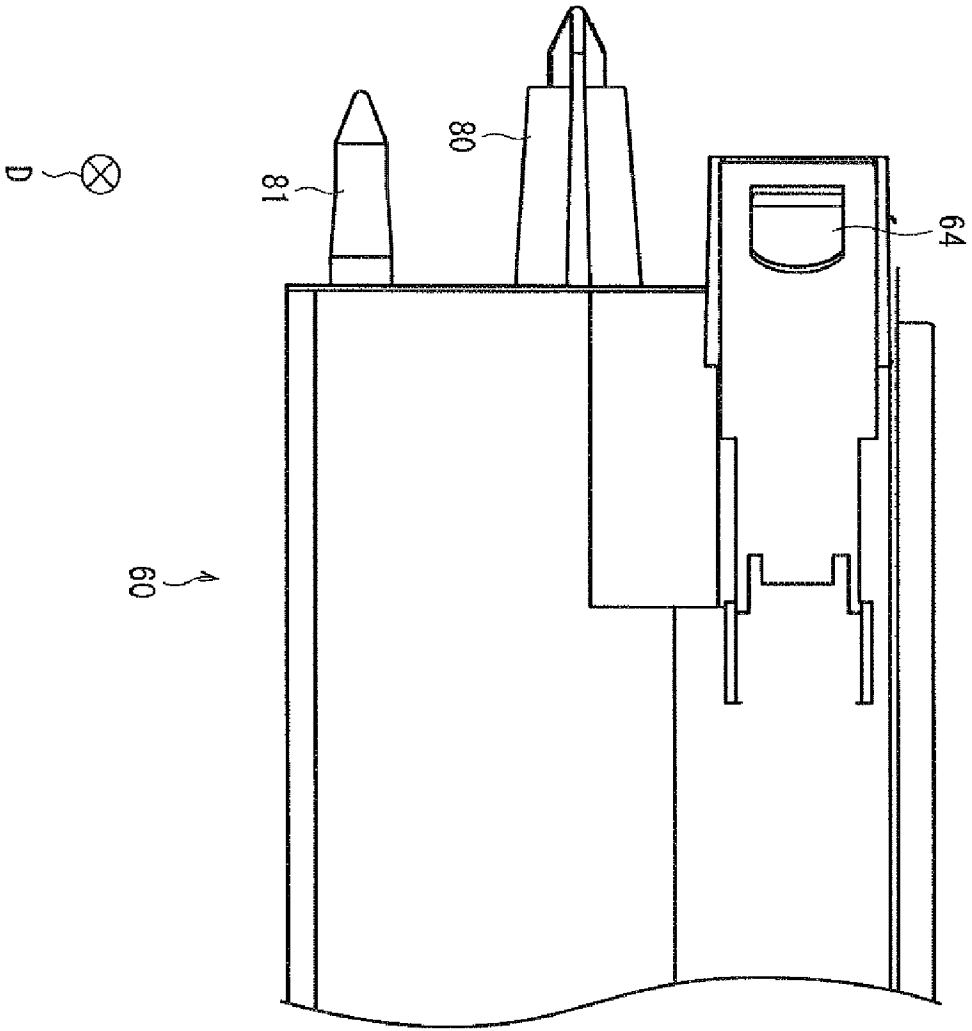
FIG. 7 shows a projection of the toner cartridge in Direction D shown in FIG. 4.

As shown in FIGS. 4, 6, and 7, the discharge outlet 64 is a through-hole formed in the cylindrical tube 62 so as to pass through a wall of the cylindrical tube 62, and is an opening via which toner stored in the toner conveying area 63*b* is dropped (discharged) out of the toner cartridge 60 into the developing device 2 (see FIG. 5). It should be noted that FIG. 6 is a perspective view of the cylindrical tube 62 and the conveying screw 65, and that FIG. 7 shows a projection of the toner cartridge 60 in Direction D of FIG. 4. For convenience of explanation, FIG. 7 omits the shutter 67.

As shown in FIG. 4, the conveying screw (conveying member) 65 is a screw member, placed so as to extend from the toner storage area 63*a* to the toner conveying area 63*b*, which rotates unidirectionally on an axis of rotation parallel to Direction A.

When the conveying screw 65 rotates, the toner stored in the toner storage area 63*a* is stirred to be conveyed in Direction A. As shown in FIG. 6, the conveying screw 65 is provided with a D-shaped hole 65*a* into which a D-shaped shaft 68 of FIG. 4 is inserted and a cylindrical blocking wall 65*b* whose axis of rotation is identical to the axis of rotation. Further, as shown in FIG. 6, the blocking wall 65*b* has a protruding portion (guided portion) 65*c* formed on an outer circumferential portion thereof.

The stirring bar 66 is a stirring bar, placed in the toner storage area 63*a*, which rotates on an axis of rotation parallel to Direction A. When the stirring bar 66 rotates, the toner stored in the toner storage area 63*a* is stirred to be fed to the vicinity of the conveying screw 65.

Figure 12:
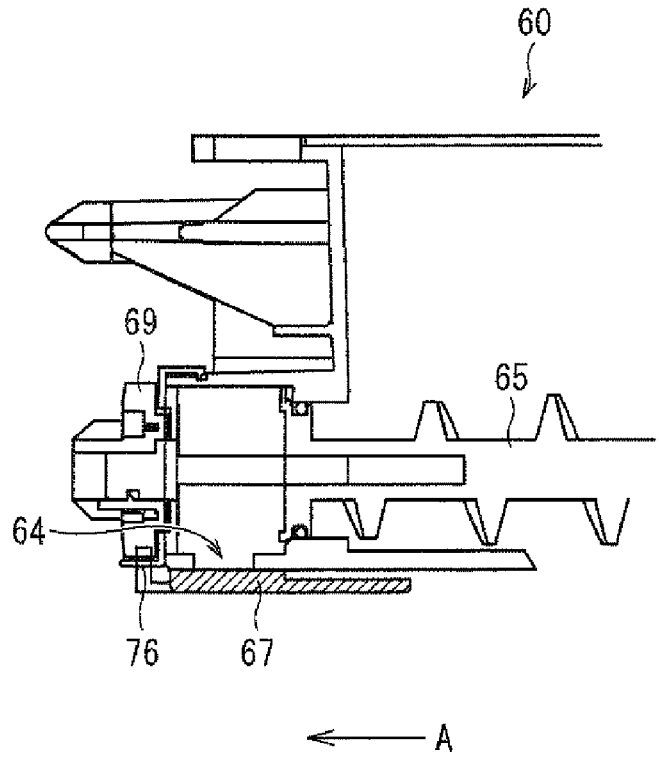
FIG. 12(*a*) shows a toner cartridge whose discharge outlet has been covered by a shutter.
Figure 12:
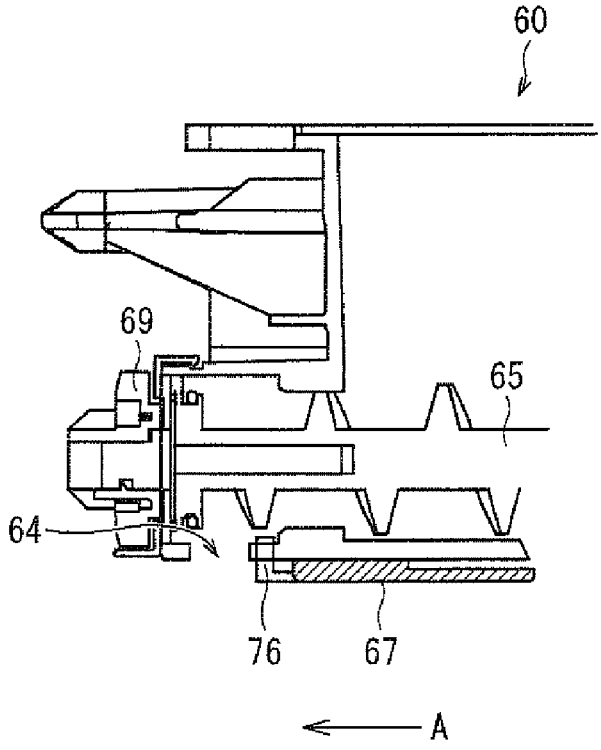

The shutter 67 is a member provided on the outside wall of the cylindrical tube 62 so as to slide on the outside wall of the cylindrical tube 62 and thereby switch between a closed state, shown in FIG. 12(*a*), in which to cover the discharge outlet 64 and a open state, shown in FIG. 12(*b*), in which to expose the discharge outlet 64. The shutter 67 is in the closed state before the toner cartridge 60 is mounted into the image forming apparatus 50 (i.e., in a brand-new state). When the toner cartridge 60 has been mounted into the image forming apparatus 50, the shutter 67 automatically switches from the closed state to the open state.

Figure 8:
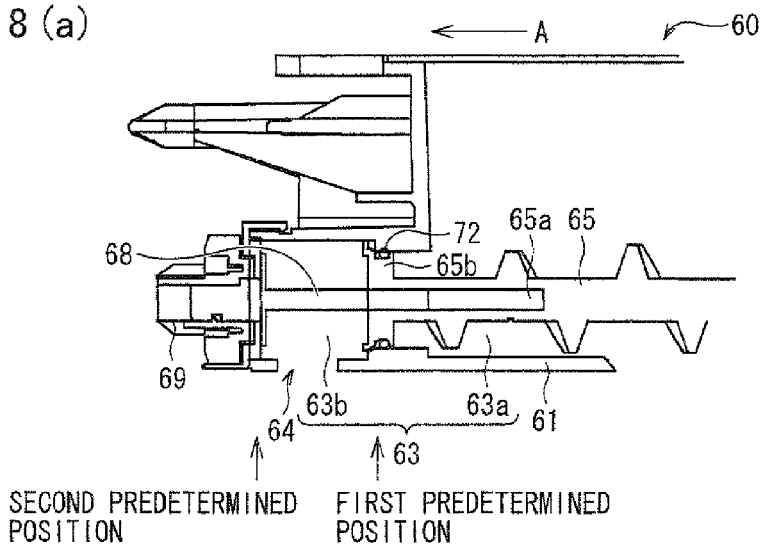
FIG. 8(*a*) shows an internal structure of a toner cartridge, according to the present embodiment, which is yet to be mounted into an image forming apparatus.
Figure 8:
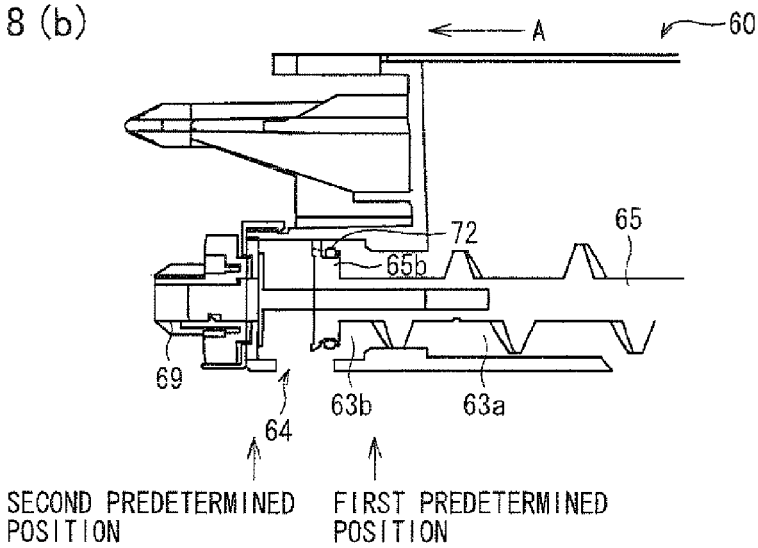
Figure 8:
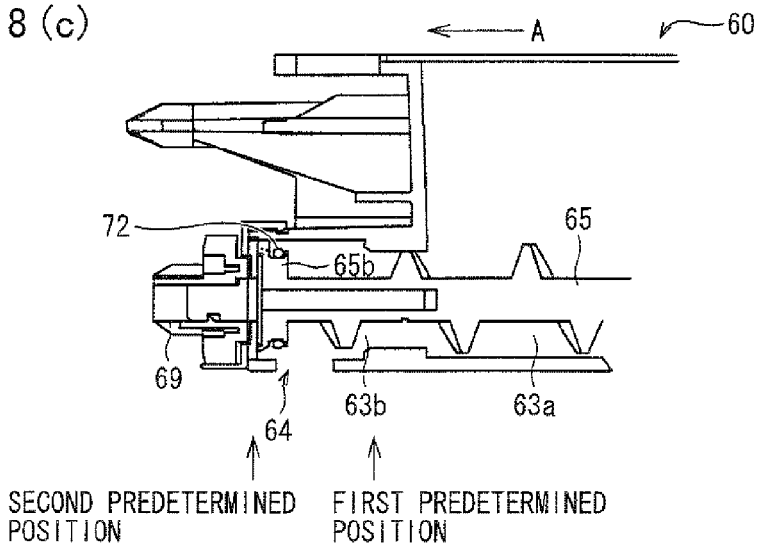

Further, the toner cartridge 60 according to the present embodiment is set so that when it has been mounted into the image forming apparatus 50, the conveying screw 65 moves a predetermined distance in Direction A in the toner storage area 63*a* and the toner conveying area 63*b*. FIG. 8(*a*) shows an internal structure of the toner cartridge 60, which is yet to be mounted into the image forming apparatus 50. FIG. 8(*b*) shows the internal structure of the toner cartridge 60, which has been mounted into the image forming apparatus 50 and whose conveying screw 65 is moving. FIG. 8(*c*) shows the internal structure of the toner cartridge 60, which has been mounted into the image forming apparatus 50 and whose conveying screw 65 has finished moving.

As shown in FIG. 8(*a*), in the state where the toner cartridge 60 is yet to be mounted into the image forming apparatus 50 (i.e., in a brand-new state), the conveying screw 65 is positioned so that the blocking wall 65*b* is placed in a first predetermined position in the toner conveying area 63*b*. Moreover, as shown in FIGS. 8(*a*) through 8(*c*), when the toner cartridge 60 has been mounted into the image forming apparatus 50, the conveying screw 65 starts to move in Direction A, with the result that the blocking wall 65*b* also moves in Direction A. The conveying screw 65 stops when the blocking wall 65*b* passes over the discharge outlet 64 and then reaches a second predetermined position.

As shown in FIGS. 8(*a*) through 8(*c*), the second predetermined position is a position, placed in the toner conveying area 63*b*, which is placed downstream from the first predetermined position in Direction A. Further, in the toner cartridge 60, the discharge outlet 64, the first predetermined position, and the second predetermined position are positioned so that the discharge outlet 64 is placed between the first predetermined position and the second predetermined position.

Furthermore, when the toner cartridge 60 is in a brand-new state (i.e., before the toner cartridge 60 is mounted into the image forming apparatus 50), the toner contained in the toner cartridge 60 is stored only in the toner storage area 63*a*. As shown in FIG. 8(*a*), the blocking wall 65*b* is blocking a space between the toner storage area 63*a* and the discharge outlet 64. Therefore, when the toner cartridge 60 is in a brand-new state, the toner stored in the toner storage area 63*a* will not reach the discharge outlet 64.

Moreover, as shown in FIG. 8(*c*), when the toner cartridge 60 has been mounted into the image forming apparatus 50, the blocking wall 65*b* is shifted to the second predetermined position, thereby opening up the space between the toner storage area 63*a* and the discharge outlet 64. Then, the toner stored in the toner storage area 63*a* is stirred by the conveying screw 65 to be conveyed to the discharge outlet 64, which is located downstream from the first predetermined position in Direction A, and is then dropped into the developing device 2 via the discharge outlet 64.

Figure 9:
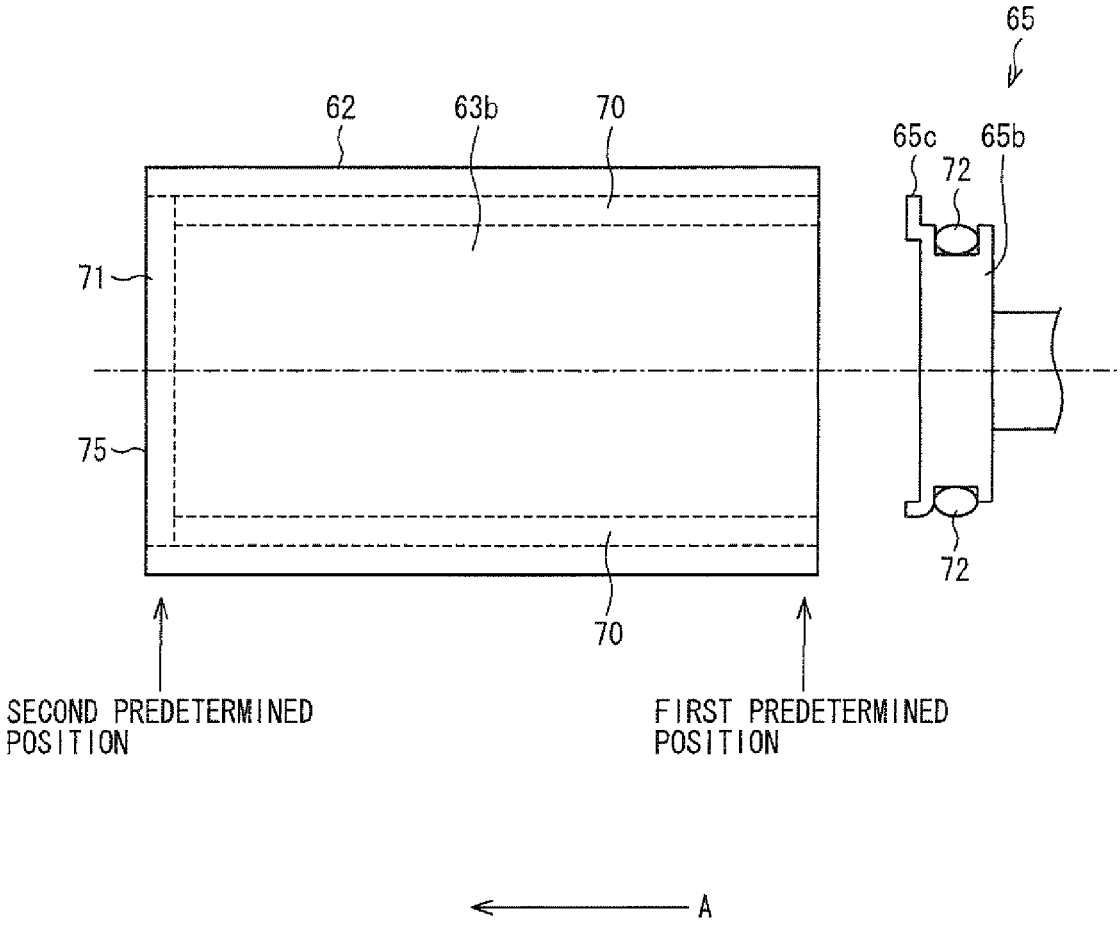
FIG. 9 schematically shows a toner conveying area of the toner cartridge according to the present embodiment and a side surface of a blocking wall of the toner cartridge according to the present embodiment.

The following details a driving mechanism for moving the conveying screw 65 in Direction A. As shown in FIGS. 4, 6, and 8(*a*), the toner cartridge 60 has the D-shaped shaft 68, the drive gear 69, and a spiral groove 70. Further, as shown in FIG. 9, the toner cartridge 60 also has a circumferential groove 71 formed in the second predetermined position in the toner conveying area 63*b*. The D-shaped shaft 68, the drive gear 69, the spiral groove 70, and the circumferential groove 71 correspond to a driving mechanism for moving the conveying screw in Direction A. It should be noted that FIG. 9 schematically shows the toner conveying area 63*b* and a side surface of the blocking wall 65*b*.

The D-shaped shaft 68 is a shaft, having an outer circumferential portion cut in the shape of D, which rotates on the same axis of rotation as the conveying screw 65. Further, as shown in FIG. 8(*a*), the D-shaped shaft 68 is placed in the toner conveying area 63*b* so as to rotate on an axis of rotation parallel to Direction A. Furthermore, as shown in FIG. 8(*a*), the D-shaped shaft 68 has been inserted in the D-shaped hole 65*a* (see FIG. 6) formed in the conveying screw 65. That is, as shown in FIG. 8(*a*), the conveying screw 65 has the D-shaped shaft 68 fitted therein. The shapes of the D-shaped shaft 68 and the D-shaped hole 65*a* are designed so that the conveying screw 65 and the D-shaped shaft 68 can rotate together and the conveying screw 65 can slide on (move over a surface of) the D-shaped shaft 68 in Direction A.

As shown in FIG. 4 and FIGS. 8(*a*) through 8(*c*), the drive gear (gear member) 69 is a gear provided on that outside wall of the toner cartridge 60 which faces in Direction A and linked to the D-shaped shaft 68. The drive gear 69 rotates the D-shaped shaft 68 by torque transmitted from a driving source (e.g., a motor; not shown) of the image forming apparatus 50.

As shown in FIG. 6, the spiral groove (guiding portion) 70 is a groove formed in an inside wall portion of the cylindrical tube 62 (i.e., on a wall surface of the toner conveying area 63*b*) and formed in a spiral manner so as to extend from the first predetermined position to the second predetermined position. Further, as shown in FIG. 6, the spiral groove 70 engages with the protruding portion 65*c* formed on the outer circumferential portion of the blocking wall 65*b*. That is, the conveying screw 65, which has the protruding portion 65*c*, is fitted into the spiral groove 70.

When the conveying screw 65 rotates under conditions where the protruding portion 65*c* and the spiral groove 70 engage with each other, the conveying screw 65 is guided by the spiral groove 70 in a direction from the first predetermined direction to the second predetermined direction (i.e., in Direction A).

As shown in FIG. 9, the circumferential groove (second groove portion) 71 is a groove formed in the second predetermined position in the toner conveying area 36 so as to circle around the inside wall portion of the cylindrical tube 62 (i.e., around the wall surface of the toner conveying area 63*b*) while rotating on the central axis of the cylindrical tube 62. That is, the internal diameter of the cylindrical tube 62 is larger in a portion provided with the circumferential groove 71 than in a portion provided with no circumferential groove 71.

Further, the circumferential groove 71 is designed so that the blocking wall 65*b*, which has moved from the first predetermined direction to the second predetermined direction, is fitted into the circumferential groove 71. Moreover, once the blocking wall 65*b* is fitted into the circumferential groove 71, the circumferential groove 71 prevents the blocking wall 65*b* from moving in Direction B and a wall surface 75 in the second predetermined position prevents the blocking wall 65*b* from moving in Direction A, although the blocking wall 65*b* can rotate on an axis of rotation parallel to Direction A. As shown in FIG. 9, the wall surface 75 is a wall formed at that end of the cylindrical tube 62 which faces in Direction A.

The following explains the operation of the driving mechanism, including the D-shaped shaft 68, the drive gear 69, the spiral groove 70, and the circumferential groove 71. First, as shown in FIG. 8(*a*), before the toner cartridge 60 is mounted into the image formation apparatus 50, the blocking wall 65*b* is placed in the first predetermined position and the protruding portion 65*c* is fitted in the spiral groove 70. Next, when the toner cartridge 60 has been mounted into the image forming apparatus 50, the drive gear 69 rotates the D-shaped shaft 68, with the result that the conveying screw 65 also rotates. Then, when the conveying screw 65 rotates, the protruding portion 65*c* formed on the outer circumferential portion of the blocking wall 65*b* slides while being fitted in the spiral groove 70 (see FIG. 6). With this, as shown in FIG. 6 and FIGS. 8(*a*) through 8(*c*), the conveying screw 65 is guided in Direction A and the blocking wall 65*b* moves from the first predetermined position to the second predetermined position. Furthermore, when the blocking wall 65*b* reaches the second predetermined position, the protruding portion 65*c* disengages from the spiral groove 70, and is then fitted into the circumferential groove 71 (see FIG. 9). With this, the blocking wall 65*b* and the conveying screw 65 having the blocking wall 65*b* are prohibited from moving in Direction A or Direction B, although the blocking wall 65*b* and the conveying screw 65 can rotate. Therefore, as shown in FIG. 8(*c*), after the blocking wall 65*b* has moved to the second predetermined position, the blocking wall 65*b* can stay in the second predetermined position to leave open the space between the toner storage area 63*a* and the discharge outlet 64, so that the toner stored in the toner storage area 63*a* can be continuously supplied out of the toner cartridge 60 into the developing device 2.

As described above, a toner cartridge 60 according to the present embodiment is arranged so as to have a toner storage chamber 63, a discharge outlet 64, a conveying screw 65, a blocking wall 65*b*, and a driving mechanism for moving the conveying screw 65 in Direction A. The toner storage chamber 63 has toner stored therein. The discharge outlet 64 is an opening, passing from the toner storage chamber 63 to the outside of the toner cartridge 60, via which the toner stored in the toner storage chamber 63 is discharged to the outside. The conveying screw 65, provided in the toner storage chamber 63, conveys, in Direction A, the toner stored in the toner storage chamber 63. The blocking wall 65*b* is formed as a part of the conveying screw 65. Further, before the toner cartridge 60 is mounted into the image forming apparatus 50, the blocking wall 65*b* is located in a space between a toner storage area 63*a*, which is an area in the toner storage chamber 63 where the toner exists, and the discharge outlet 64, thereby putting the space in a blocked state. Moreover, when the toner cartridge 60 has been mounted into the image forming apparatus 50, the driving mechanism cancels the blocked state by moving (driving) the conveying screw 65 in Direction A with use of power transmitted from the image forming apparatus 50.

Before such a toner cartridge 60 is mounted into the image forming apparatus 50, the blocking wall 65*b* blocks the space between the toner storage area 63*a* and the discharge outlet 64, so that the toner stored in the toner storage area 63*a* will not reach the discharge outlet 64 and therefore will not leak through the discharge outlet 64. Moreover, when the toner cartridge 60 has been mounted into the image forming apparatus 50, the driving mechanism moves the conveying screw 65 in Direction A with use of power transmitted from the image forming apparatus 50, so as to open up the space between the toner storage area 63*a* and the discharge outlet 64 (so as to cancel the blocked state). Therefore, after the toner cartridge 60 has been mounted into the image forming apparatus 50, the toner stored in the toner storage area 63*a* can reach the discharge outlet 64, so that the toner can be discharged out of the toner cartridge 60 via the discharge outlet 64.

Figure 1:
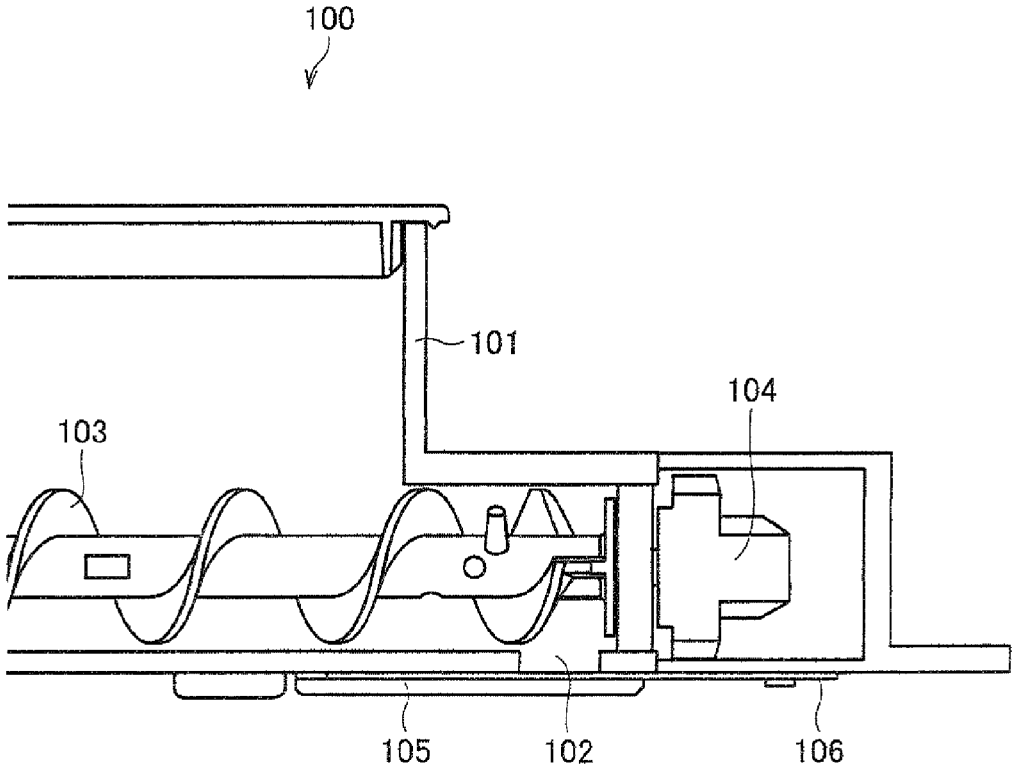
FIG. 1 schematically shows a conventional toner cartridge.

That is, the toner cartridge 60 thus described does not require a heat seal (see 106 of FIG. 1) required for a conventional toner cartridge, can prevent leakage of the toner through the discharge outlet 64 before being mounted into the image forming apparatus 50, and can also discharge the toner via the discharge outlet 64 after having been mounted into the image forming apparatus 50. Therefore, the above-described toner cartridge 60 can inhibit dirt from occurring due to use of the heat seal (inhibit dirt from occurring in the user's hands and surroundings due to the toner scattered around when the heat seal was pulled out).

Further, the present embodiment is such that: the first predetermined position corresponds to a position in which the blocking wall 65*b* is placed during the blocked state; the second predetermined position corresponds to a position in which the blocking wall 65*b* is placed once the blocked state is canceled; and the discharge outlet 64 is placed between the first predetermined position and the second predetermined position. Moreover, when the toner cartridge 60 has been mounted into the image forming apparatus 50, the driving mechanism moves the conveying screw 65 in Direction A so that the blocking wall 65*b* moves from the first predetermined position to the second predetermined position. Therefore, after the blocking wall 65*b* has moved to the second predetermined position, the blocking wall 65*a* no longer exists between the toner storage area 63*a* and the discharge outlet 64. This makes it possible to prevent the blocking wall 65*b* from inhibiting passage of the toner from the toner storage area 63*a* to the discharge outlet 64.

Furthermore, in the present embodiment, the driving mechanism for moving the conveying screw 65 in Direction A has a D-shaped shaft 68, a spiral groove 70, and a drive gear 69. The D-shaped shaft 68 is a shaft, fitted in the conveying screw 65 so that the conveying screw 65 can move in Direction A, which rotates together with the conveying screw 65 on an axis of rotation parallel to Direction A. The spiral groove 70 is formed so as to extend from the first predetermined position to the second predetermined position. Further, the spiral groove 70 is a groove, formed in a spiral manner so that the conveying screw 65 is guided in Direction A when the conveying screw 65 rotates, into which a protruding portion 65*c* of the blocking wall 65*b* is fitted. The drive gear 69 is a gear member for rotating the D-shaped shaft by power transmitted from the image forming apparatus 50.

Such a driving mechanism makes it possible to move the conveying screw 65 in Direction A (i.e., in a direction from the first predetermined direction to the second predetermined direction while rotating the conveying screw 65, and to move the blocking wall 65*b*, formed as a part of the conveying screw 65, from the first predetermined direction to the second predetermined direction.

Further, as shown in FIG. 9, formed in the second predetermined position in the toner conveying area 63*b* is a circumferential groove 71 into which the blocking wall 65*b* is fitted so that movement of the conveying screw 65 is prevented. The blocking wall 65*b* is fitted into the circumferential groove 71 when reaching the second predetermined position. With this, after the blocking wall 65 has reached the second predetermined position, it becomes possible to prevent movement of the conveying screw 65 and the blocking wall 65*b* while rotating the conveying screw 65. Therefore, the blocking wall 65*b* will not return to the first predetermined position, and therefore can leave open the space between the toner storage area 63*a* and the discharge outlet 64.

Furthermore, in the toner cartridge 60 according to the present embodiment, it is preferable to fit an O-ring (seal member) 72 to an outer circumferential portion of the blocking wall 65*b* so as to completely seal a gap between a wall surface of the toner storage chamber 63 (toner conveying area 63*b*) and the outer circumferential portion of the blocking wall 65*b* in cases where the blocking wall 65*b* is in the first predetermined position (see FIGS. 8(*a*) and 9). This makes it possible to highly precisely prevent the toner stored in the toner storage area 63*a* from leaking to the discharge outlet 64 through the blocking wall 65*b* before the toner cartridge 60 is mounted into the image forming apparatus 50.

Further, it is preferable that the O-ring 72 be made of silicon rubber. The following explains the reason for this. Since silicon rubber is high in resiliency and resists heat, use of an O-ring 72 made of silicon rubber makes it possible to reduce frictional resistance and stress that act on the O-ring 72. This makes it possible to prevent an undesirable effect of damaging the O-ring 72 and an undesirable effect of impairing the closeness of the gap between the wall surface of the toner storage chamber 63 and the blocking wall 65*b*.

Figure 10:
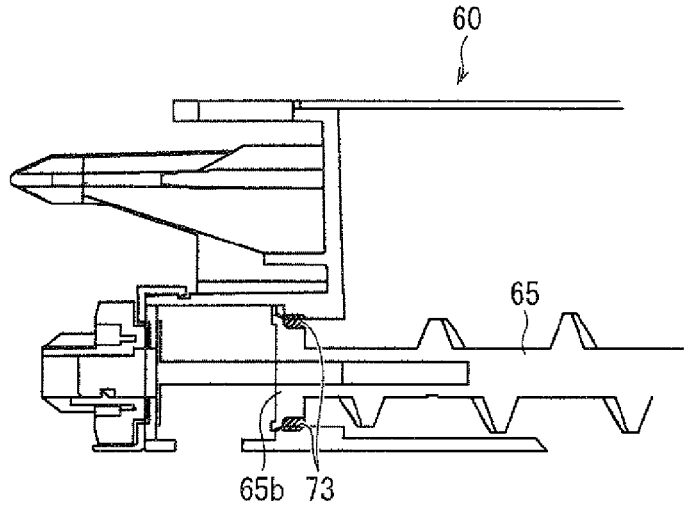
FIG. 10(*a*) shows an internal structure of a toner cartridge whose blocking wall has been coated with silicon rubber.
Figure 10:
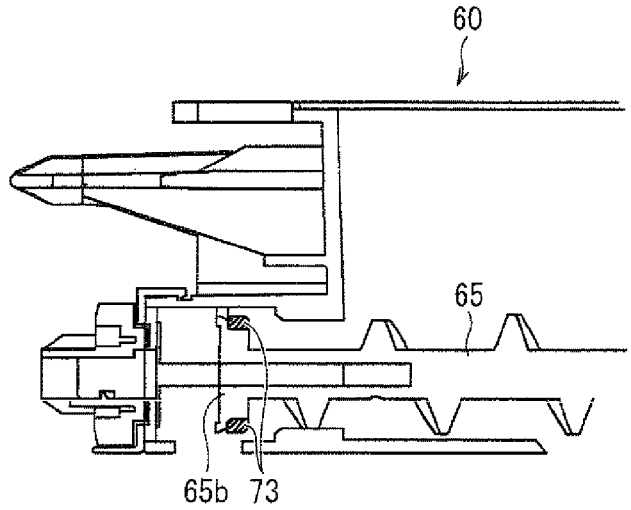
Figure 10:
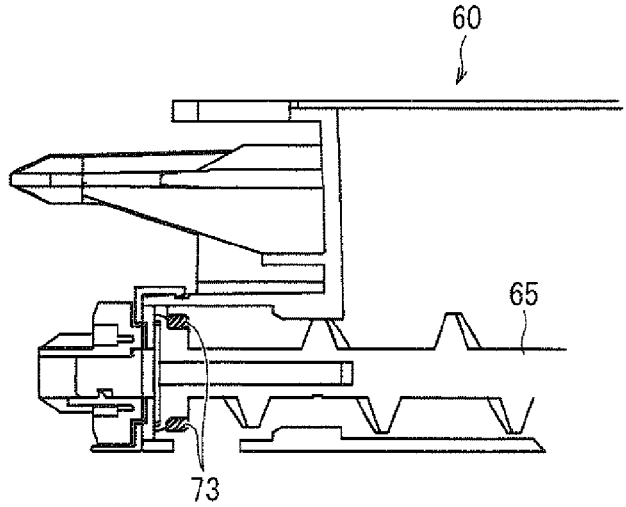
Figure 11:
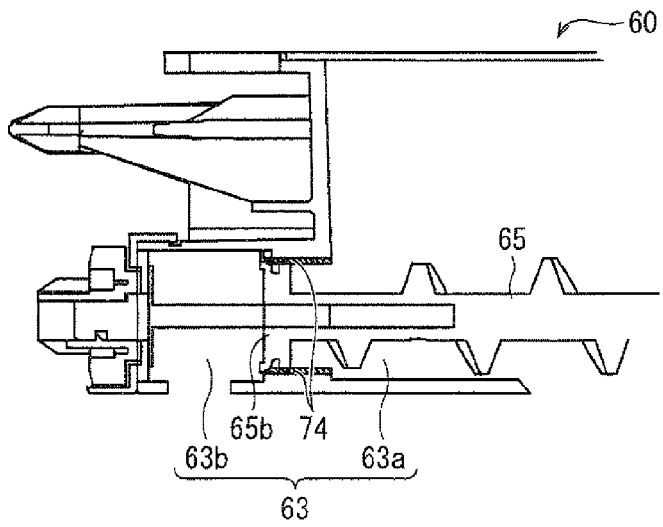
FIG. 11(*a*) shows an internal structure of a toner cartridge whose toner storage chamber has a wall coated with silicon rubber.
Figure 11:
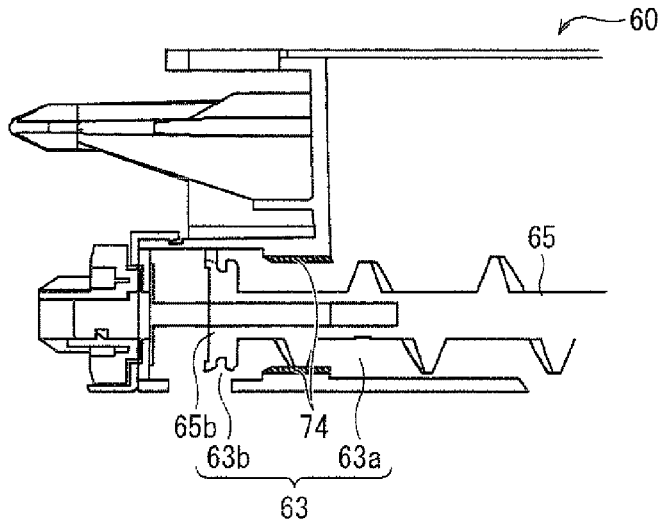
Figure 11:
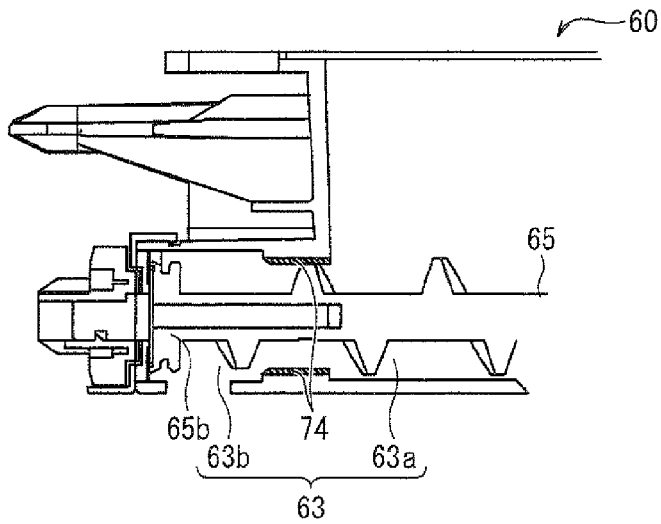

Further, instead of fitting the O-ring 72 to the outer circumferential portion of the blocking wall 65*b*, it is possible to coat the outer circumferential portion of the blocking wall 65*b* with silicon rubber (seal member) 73, as shown in FIGS. 10(*a*) through 10(*c*), so that the silicon rubber 73 seals the gap between the wall surface of the toner storage chamber 63 and the blocking wall 65*b* in cases where the blocking wall 65*b* is in the first predetermined position. Alternatively, it is possible to coat the wall surface of the toner storage chamber 63 with silicon rubber (seal member) 74, as shown in FIGS. 11(*a*) through 11(*c*), so that the silicon rubber 74 seals the gap between the wall surface of the toner storage chamber 63 and the blocking wall 65*b* in cases where the blocking wall 65*b* is in the first predetermined position. In the case of an arrangement shown in FIGS. 10(*a*) through 10(*c*) or FIGS. 11(*a*) through 11(*c*), the O-ring 72 is no longer required. This makes it possible to reduce the number of components and thereby simplify the process of assembling the toner cartridge 60.

Furthermore, as shown in FIGS. 12(*a*) and 12(*b*), the toner cartridge 60 includes a shutter 67, and may further has a gear lock (anti-rotation member) 76 provided at that end of the shutter 67 which faces in Direction A. The following details the gear lock 76.

In the present embodiment, the shutter 67 slides in a direction opposite to Direction A (i.e., in Direction B) when the toner cartridge 60 is mounted into the image forming apparatus 50, thereby varying in position between before and after the mounting. Therefore, the gear lock 76 provided to the shutter 67 also varies in position between before and after the mounting.

More specifically, before the toner cartridge 60 is mounted into the image forming apparatus 50, the gear lock 76 is located, as shown in FIG. 12(*a*), so as to make contact with the drive gear 69 on a rotational orbit of the drive gear 69. With this, the gear lock 76 makes contact with the drive gear 69 so as to prevent rotation of the drive gear 69. Therefore, even when the drive gear 69 is subjected to turning force, rotation of the drive gear 69 is inhibited. On the other hand, after the toner cartridge 60 has been mounted into the image forming apparatus 50, the gear lock 76 deviates from the rotational orbit of the drive gear 69 as shown in FIG. 12(*b*), and is then located so as to disengage from the drive gear 69. With this, the gear lock 76 does not make contact with the drive gear 69, so that the drive gear 69 rotates when subjected to turning force.

That is, before the toner cartridge 60 is mounted into the image forming apparatus 50, the gear lock 76 makes contact with the drive gear 69, thereby maintaining an anti-rotation state in which to prevent rotation of the drive gear 69. Once the toner cartridge 60 is mounted into the image forming apparatus 50, the gear lock 76 cancels the anti-rotation state by disengaging from the drive gear 69. This makes it possible to prevent the user from making a mistake touching the drive gear 69 with his/her hands before the toner cartridge 60 is mounted into the image forming apparatus 50 and thereby rotating the drive gear 69 to move the conveying screw 65 and the blocking wall 65*b* to open up the space between the toner storage area 63*a* and the discharge outlet 64.

Further, as shown in FIG. 6, it is preferable that the amount of rotation that the drive gear 69 is required to complete in order to move the blocking wall 65*b* from the first predetermined position to the second predetermined position be set to be not more than one rotation. This makes it possible to shift the space between the toner storage area 63*a* and the discharge outlet 64 from the blocked state to an open state only by causing the drive gear 69 to complete at least one rotation. Therefore, it becomes possible to discharge the toner via the discharge outlet 64 soon after the toner cartridge 60 has been mounted into the image forming apparatus 50.

Furthermore, in the toner cartridge 60 thus shown, the conveying screw 65 is guided in Direction A by the protruding portion 65*c* formed on the outer circumferential portion of the blocking wall 65*b* as shown in FIG. 6 and the spiral groove 70, formed on an inside wall of the cylindrical tube 62 (i.e., on a wall surface of the toner conveying area 63*b*) as shown in FIG. 6, which engages with the protruding portion 65*c*. However, the conveying screw 65 may be guided in Direction A by a groove (first groove portion, guided portion) formed on the outer circumferential portion of the blocking wall 65*b* instead of the protruding portion 65*c* and a protruding rail (guiding portion), formed in a spiral manner on the inside wall of the cylindrical tube 62, which engages with the groove (first groove portion).

Further, although the image forming apparatus 50 is a laser printer in the above embodiment, the image forming apparatus 50 is not limited to a laser printer as long as it is an electrophotographic image forming apparatus, and may be a printer in which an array of LEDs exposes a photosensitive drum. Further, the image forming apparatus 50 does not need to be specialized as a printer, and may be a copier, a multifunction printer, or a facsimile machine. Further, the image forming apparatus 50 is not limited to a color image forming apparatus, and may be a monochrome image forming apparatus.

A toner cartridge according to the present embodiment is a toner cartridge to be mounted into an electrophotographic image forming apparatus, the toner cartridge including: a toner storage chamber having toner stored therein and provided with a discharge outlet via which the toner is discharged out of the toner cartridge; a conveying screw, provided in the toner storage chamber, which conveys the toner stored in the toner storage chamber; a blocking wall, formed as a part of the conveying screw, which is located in a space between a toner area and the discharge outlet, thereby putting the space in a blocked state, the toner area being an area in the toner storage chamber where the toner exists; and a driving mechanism for, when the toner cartridge has been mounted into the image forming apparatus, driving the conveying screw by power transmitted from the image forming apparatus, so as to cancel the blocked state.

According to the foregoing arrangement, before such a toner cartridge is mounted into the image forming apparatus, the blocking wall blocks the space between the toner area, which is an area in the toner storage chamber where the toner exists, and the discharge outlet, so that the toner stored in the toner storage chamber will not reach the discharge outlet and therefore will not leak through the discharge outlet. Moreover, when the toner cartridge has been mounted into the image forming apparatus, the driving mechanism moves the conveying screw with use of power transmitted from the image forming apparatus, so as to cancel the blocked state. Therefore, after the toner cartridge has been mounted into the image forming apparatus, the toner stored in the toner storage chamber can reach the discharge outlet, so that the toner can be discharged out of the toner cartridge via the discharge outlet.

That is, the arrangement of the present technology does not require a heat seal (see 106 of FIG. 1) required for a conventional toner cartridge, can prevent leakage of the toner through the discharge outlet 64 before the mounting, and can also discharge the toner via the discharge outlet after the mounting. This makes it possible to inhibit dirt from occurring due to use of the heat seal (to inhibit dirt from occurring in the user's hands and surroundings due to the toner scattered around when the heat seal was pulled out).

The toner cartridge according to the present embodiment is preferably arranged such that: the driving mechanism is a mechanism that moves the conveying screw so that the blocking wall moves from a first predetermined position to a second predetermined position, the first predetermined position being a position in which the blocking wall is placed during the blocked state, the second predetermined position being a position in which the blocking wall is placed once the blocked state is canceled; and the discharge outlet is placed between the first predetermined position and the second predetermined position. With this, after the blocked state has been canceled, the blocking wall no longer exists between the toner area, which is an area in the toner chamber where the toner exists, and the discharge outlet. This makes it possible to prevent the blocking wall from inhibiting passage of the toner from the toner area to the discharge outlet.

The toner cartridge according to the present embodiment is preferably arranged such that: the conveying screw has a guided portion, formed on an outer circumferential portion of the blocking wall, which serves as a first groove portion or a protruding portion; and the driving mechanism has (i) a shaft, fitted in the conveying screw so that the conveying screw is able to move in a moving direction from the first predetermined position to the second predetermined position, which rotates together with the conveying screw so that the moving direction is along a rotation axis of the shaft, (ii) a guiding portion, formed so as to extend from the first predetermined position to the second predetermined position, which fits the conveying screw thereinto by engaging with the guided portion, the guiding portion being formed in a spiral manner so that the conveying screw is guided in the moving direction when the conveying screw rotates, and (iii) a gear member for rotating the shaft by power transmitted from the image forming apparatus. This arrangement makes it possible to move the conveying screw in the moving direction (i.e., in a direction from the first predetermined direction to the second predetermined direction) while rotating the conveying screw by power transmitted from the image forming apparatus, and to move the blocking wall, formed as a part of the conveying screw, from the first predetermined direction to the second predetermined direction.

In addition to the foregoing arrangement, the toner cartridge according to the present embodiment is preferably arranged so as to further include a second groove portion, formed in the second predetermined position, into which the blocking wall is fitted so that movement of the conveying screw is prevented once the blocked state is canceled. With this, once the blocking wall, formed as a part of the conveying screw, reaches the second predetermined position, the conveying screw 65 is prevented from moving in the moving direction or a direction opposite to the moving direction, although the conveying screw can rotate. Therefore, the blocking wall, formed as a part of the conveying screw, will not return to the first predetermined position, and therefore can keep the blocked state canceled.

In addition to the foregoing arrangement, the toner cartridge according to the present embodiment is preferably arranged so as to further include a seal member closing a gap between a wall surface of the toner storage chamber and the blocking wall. This makes it possible to highly precisely prevent the toner stored in the toner area from leaking to the discharge outlet through the blocking wall before the toner cartridge is mounted into the image forming apparatus.

Further, it is preferable that the seal member be made of silicon rubber. The following explains the reason for this. Since silicon rubber is high in resiliency and resists heat, use of a seal member made of silicon rubber makes it possible to reduce frictional resistance and stress that act on the seal member. This makes it possible to prevent an undesirable effect of damaging the seal member and an undesirable effect of impairing the closeness of the gap between the wall surface of the toner storage chamber and the blocking wall.

Further, the seal member may be an O-ring fitted to the outer circumferential portion of the blocking wall. Further, the seal member may coat the outer circumferential portion of the blocking wall or the wall surface of the toner storage chamber. In the case of an embodiment in which the seal member coats the outer circumferential portion or the wall surface, it is possible to reduce the number of components and thereby simplify the process of assembling the toner cartridge.

Furthermore, in addition to the foregoing arrangement, the toner cartridge according to the present embodiment is preferably arranged so as to further include an anti-rotation member that, before the toner cartridge is mounted into the image forming apparatus, maintains an anti-rotation state in which to prevent rotation of the gear member by making contact with the gear member and that, once the toner cartridge is mounted into the image forming apparatus, cancels the anti-rotation state by disengaging from the gear member. This makes it possible to prevent the user from making a mistake touching the gear member with his/her hands before the toner cartridge is mounted into the image forming apparatus and thereby rotating the gear member to move the conveying screw and the blocking wall to cancel the blocked state.

Further, the toner cartridge according to the present embodiment is preferably arranged such that the amount of rotation that the gear member is required to complete in order to move the blocking wall from the first predetermined position to the second predetermined position is set to be not more than one rotation. This makes it possible to cancel the blocked state by causing the gear member to complete at least one rotation. Therefore, it becomes possible to discharge the toner via the discharge outlet 64 soon after the toner cartridge has been mounted into the image forming apparatus.

The toner cartridge according to the present embodiment is suitable for electrophotographic printers, copiers, multifunction printers, and facsimile machines.

The present technology is not limited to the description of the embodiments above, but may be altered by a skilled person within the scope of the claims. An embodiment based on a proper combination of technical means disclosed in different embodiments is encompassed in the technical scope of the present technology.

The embodiments and concrete examples of implementation discussed in the foregoing detailed explanation serve solely to illustrate the technical details of the present technology, which should not be narrowly interpreted within the limits of such embodiments and concrete examples, but rather may be applied in many variations within the spirit of the present technology, provided such variations do not exceed the scope of the patent claims set forth below.

What is claimed is:

1. A toner cartridge to be mounted into an electrophotographic image forming apparatus, the toner cartridge comprising:

a toner storage chamber having toner stored therein and provided with a discharge outlet via which the toner is discharged out of the toner cartridge;

a conveying screw, provided in the toner storage chamber, which conveys the toner stored in the toner storage chamber;

a blocking wall, formed as a part of the conveying screw, which is located in a space between a toner area and the discharge outlet, thereby putting the space in a blocked state, the toner area being an area in the toner storage chamber where the toner exists; and a driving mechanism for, when the toner cartridge has been mounted into the image forming apparatus, driving the conveying screw by power transmitted from the image forming apparatus, so as to cancel the blocked state, wherein:

the driving mechanism is a mechanism that moves the conveying screw so that the blocking wall moves from a first predetermined position to a second predetermined position, the first predetermined position being a position in which the blocking wall is placed during the blocked state, the second predetermined position being a position in which the blocking wall is placed once the blocked state is canceled;

the discharge outlet is placed between the first predetermined position and the second predetermined position the conveying screw has a guided portion, formed on an outer circumferential portion of the blocking wall, which serves as a first groove portion or a protruding portion; and the driving mechanism has (i) a shaft, fitted in the conveying screw so that the conveying screw is able to move in a moving direction from the first predetermined position to the second predetermined position, which rotates together with the conveying screw so that the moving direction is along a rotation axis of the shaft, (ii) a guiding portion, formed so as to extend from the first predetermined position to the second predetermined position, which fits the conveying screw thereinto by engaging with the guided portion, the guiding portion being formed in a spiral manner so that the conveying screw is guided in the moving direction when the conveying screw rotates, and (iii) a gear member for rotating the shaft by power transmitted from the image forming apparatus.

2. The toner cartridge as set forth in claim 1, further comprising a second groove portion, formed in the second predetermined position, into which the blocking wall is fitted so that movement of the conveying screw is prevented once the blocked state is canceled.

3. The toner cartridge as set forth in claim 1, further comprising a seal member closing a gap between a wall surface of the toner storage chamber and the blocking wall.

4. The toner cartridge as set forth in claim 3, wherein the seal member is made of silicon rubber.

5. The toner cartridge as set forth in claim 3, wherein the seal member is an O-ring fitted to the outer circumferential portion of the blocking wall.

6. The toner cartridge as set forth in claim 3, wherein the seal member coats the outer circumferential portion of the blocking wall or the wall surface of the toner storage chamber.

7. The toner cartridge as set forth in claim 1, further comprising an anti-rotation member that, before the toner cartridge is mounted into the image forming apparatus, maintains an anti-rotation state in which to prevent rotation of the gear member by making contact with the gear member and that, once the toner cartridge is mounted into the image forming apparatus, cancels the anti-rotation state by disengaging from the gear member.

8. The toner cartridge as set forth in claim 1, wherein the amount of rotation that the gear member is required to complete in order to move the blocking wall from the first predetermined position to the second predetermined position is set to be not more than one rotation.

9. An electrophotographic image forming apparatus into which the toner cartridge of claim 1 is mounted.

* * * * *